US007559850B2

(12) United States Patent
Gilbert et al.

(10) Patent No.: US 7,559,850 B2
(45) Date of Patent: Jul. 14, 2009

(54) IRON-TYPE GOLF CLUBS

(75) Inventors: Peter J. Gilbert, Carlsbad, CA (US); Bruce R. Pettibone, Carlsbad, CA (US); Michael Scott Burnett, Carlsbad, CA (US); Christopher R. Kays, San Marcos, CA (US); Tomas Diaz, Winchester, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 11/367,472

(22) Filed: Mar. 3, 2006

(65) Prior Publication Data

US 2006/0234805 A1 Oct. 19, 2006

Related U.S. Application Data

(63) Continuation-in-part of application No. 11/193,745, filed on Jul. 29, 2005, now Pat. No. 7,232,377, which is a continuation-in-part of application No. 11/105,631, filed on Apr. 14, 2005, now Pat. No. 7,186,187.

(51) Int. Cl.
*A63B 53/04* (2006.01)

(52) U.S. Cl. ..... 473/290; 473/332; 473/345; 473/350

(58) Field of Classification Search ..... 473/290–291, 473/350, 332, 345
See application file for complete search history.

(56) References Cited

U.S. PATENT DOCUMENTS 4,340,230 A 7/1982 Churchward
4,420,156 A 12/1983 Campau
4,928,972 A 5/1990 Nakanishi et al.
5,160,136 A * 11/1992 Eger ..... 473/291
5,290,036 A * 3/1994 Fenton et al. ..... 473/332
5,388,826 A 2/1995 Sherwood
5,429,353 A * 7/1995 Hoeflich ..... 473/350
5,480,145 A 1/1996 Sherwood
5,547,426 A 8/1996 Wood
5,591,092 A 1/1997 Gilbert
5,707,302 A 1/1998 Leon et al.
5,800,282 A 9/1998 Hutin et al.
5,967,903 A 10/1999 Cheng
5,976,029 A 11/1999 Sherwood
6,045,456 A 4/2000 Best et al.
6,196,934 B1 3/2001 Sherwood
6,290,607 B1 9/2001 Gilbert et al.
6,358,158 B2 * 3/2002 Peters et al. ..... 473/291

(Continued)

*Primary Examiner*—Stephen L. Blau
(74) *Attorney, Agent, or Firm*—Michael J. Mancuso

(57) ABSTRACT

A set of iron-type golf clubs includes long, mid- and short irons with channel back configurations and a mass control insert. The mass of the insert is systematically varied through the set such that the mass distribution properties of the set may be systematically varied while retaining a continuous look and feel through the set. The mass of the insert is varied by altering the volume or the density of the insert through the set. Additional design parameters for the set may also be systematically varied through the set, such as groove type and depth, loft angle, cavity volume, hitting face roughness, and sole width. In one embodiment, the mass control insert comprises a dense insert and a lightweight cover. The density of the dense insert can be easily varied to change the mass distribution properties of the club head. One application of the mass control insert is to provide customization of the club head at the point of sale or distribution.

4 Claims, 9 Drawing Sheets

U.S. PATENT DOCUMENTS

| | | | | |
|---|---|---|---|---|
| D473,606 | S | 4/2003 | Mickelson et al. | |
| 6,547,675 | B2 | 4/2003 | Sherwood | |
| 6,599,988 | B2 | 7/2003 | Wang et al. | |
| 6,605,007 | B1 | 8/2003 | Bissonnette et al. | |
| 6,688,989 | B2 | 2/2004 | Best | |
| 6,719,641 | B2 | 4/2004 | Dabbs et al. | |
| 6,863,621 | B2 | 3/2005 | Sherwood | |
| 2002/0098910 | A1 * | 7/2002 | Gilbert | 473/332 |
| 2003/0228928 | A1 * | 12/2003 | Yabu | 473/290 |

* cited by examiner

IRON-TYPE GOLF CLUBS

CROSS-REFERENCE TO RELATED APPLICATION

The present application is a continuation-in-part of U.S. application Ser. No. 11/193,745 filed on Jul. 29, 2005, now U.S. Pat. No. 7,232,377, which is a continuation-in-part of U.S. Application Ser. No. 11/105,631 filed on Apr. 14, 2005, now U.S. Pat. No. 7,186,187, which are both incorporated herein by reference in their entireties.

FIELD OF THE INVENTION

This invention generally relates to golf clubs, and, more particularly, to iron clubs.

BACKGROUND OF THE INVENTION

Individual iron club heads in a set typically increase progressively in face surface area and weight as the clubs progress from the long irons to the short irons and wedges. Therefore, the club heads of the long irons have a smaller face surface area than the short irons and are typically more difficult for the average golfer to hit consistently well. For conventional club heads, this arises at least in part due to the smaller sweet spot of the corresponding smaller face surface area.

To help the average golfer consistently hit the sweet spot of a club head, many golf clubs are available with cavity back constructions for increased perimeter weighting. Perimeter weighting also provide the club head with higher rotational moment of inertia about its center of gravity. Club heads with higher moment of inertia have a lower tendency to rotate caused by off-center hits. Another recent trend has been to increase the overall size of the club heads. Each of these features increases the size of the sweet spot, and therefore makes it more likely that a shot hit slightly off-center still makes contact with the sweet spot and flies farther and straighter. One challenge for the golf club designer when maximizing the size of the club head is to maintain a desirable and effective overall weight of the golf club. For example, if the club head of a three iron is increased in size and weight, the club may become more difficult for the average golfer to swing properly.

In general, to increase the sweet spot, the center of gravity of these clubs is moved toward the bottom and back of the club head. This permits an average golfer to launch the ball up in the air faster and hit the ball farther. In addition, the moment of inertia of the club head is increased to minimize the distance and accuracy penalties associated with off-center hits. In order to move the weight down and back without increasing the overall weight of the club head, material or mass is taken from one area of the club head and moved to another. One solution has been to take material from the face of the club, creating a thin club face. Examples of this type of arrangement can be found in U.S. Pat. Nos. 4,928,972, 5,967,903 and 6,045,456.

However, for a set of irons, the performance characteristics desirable for the long irons generally differ from that of the short irons. For example, the long irons are more difficult to hit accurately, even for professionals, so having long irons with larger sweet spots is desirable. Similarly, short irons are generally easier to hit accurately, so the size of the sweet spot is not as much of a concern. However, greater workability of the short irons is often demanded.

Fine tuning the center of gravity and moment of inertia properties is difficult to achieve while simultaneously attempting to capture within a set of clubs a continuous aesthetic look and feel. Currently, in order to produce the best overall game results, golfers may have to buy their clubs individually, which results in greater play variation through the set than is desirable. Additionally, if different clubs from different manufacturers are used, any given club within a piecemeal set could have the correct playing standards but lack the desired feel for a golfer. Therefore, there exists a need in the art for a set of clubs where the individual clubs in the set are designed to yield an overall maximized performance continuum for the set while maintaining a consistent aesthetic look and feel during play.

SUMMARY OF THE INVENTION

According to one aspect of the present invention, a set of iron-type golf clubs includes at least one long iron comprising a first hitting face, a first rear face having a first channel formed therein, and a first insert disposed behind the first hitting face. The set also includes at least one short iron comprising a second hitting face, a second rear face having a second channel formed therein, and a second insert disposed behind the second hitting face. The first insert mass on the long iron and the second insert mass on the short iron differ systematically.

According to another aspect of the present invention, an iron-type golf club head includes a body made of a forged material having a first density with a hitting face integrally formed on the body. A rear flange is connected to the hitting face, with a channel formed within the rear flange between the rear flange and the hitting face. An insert is configured to be in contact with the rear flange and the hitting face, wherein the insert is made of a second material having a second density, wherein the second density is lower than the first density.

According to another aspect of the present invention, a method of customizing a golf club head comprises the steps of:

(i) providing the golf club head;

(ii) providing a plurality of mass control inserts;

(iii) providing a means for securing a mass control insert to the golf club head;

(iv) testing the golf club head with each of the plurality of mass control inserts; and (v) securing one of the plurality of mass control inserts to the golf club head.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
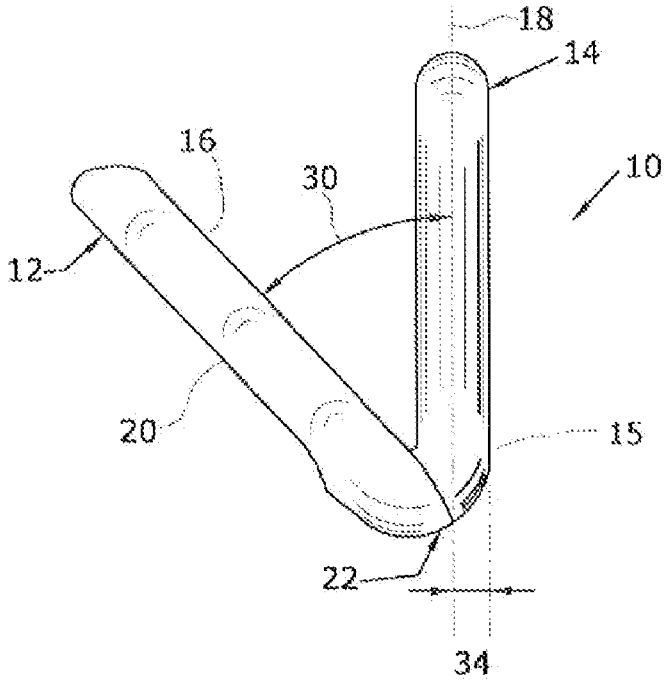
FIG. 1 is a toe view of a club head.

As illustrated in the accompanying drawings and discussed in detail below, the present invention is directed to a set of iron-type golf clubs. For the purposes of illustration, FIG. 1 shows a reference iron-type club head 10 for defining various design parameters for the present invention. These design parameters for the clubs are chosen such that the parameters progress through the set from the long irons to the short irons in a pre-determined fashion. Club head 10 is attached to a shaft (not shown) in any manner known in the art.

Club head 10 includes, generally, a body 12 and a hosel 14. Body 12 includes a striking or hitting face 16 and a rear face 20. Body 12 is attached to hosel 14 at an angle, such that a loft angle 30 is defined between a hosel center line 18 and hitting face 16. Further, the relative configuration of body 12 and hosel 14 results in an offset 34 between the leading edge 22 of the base of the hitting face and the forward-most point 15 of the hosel.

In a typical set of golf clubs, the area of hitting face 16, the heel-to-toe length of body 12, loft angle 30, and offset 34 vary from club to club within the set. For example, long irons, such as a 2-, 3-, or 4-iron using conventional numbering, typically include relatively long shafts, relatively small areas for hitting face 16, and relatively low loft angles 30. Similarly, short irons, such as an 8-iron, 9-iron, the pitching wedge, or the sand wedge using conventional designations, typically include relatively short shafts, relatively larger areas for hitting face 16, and relatively high loft angles 30. In the present invention, these parameters are particularly chosen to maximize the performance of each club for its intended use. Further, these parameters progress in a predetermined fashion through the set.

Similarly, in many typical sets, loft angle 30 increases as the set progresses from the long irons (2, 3, 4) to the short irons (8, 9, PW). For the long irons, loft angle 30 varies linearly: approximately a three-degree increase. Similarly, for the short irons, loft angle 30 varies linearly: approximately a four-degree increase. Other variations of loft angle 30 are within the scope of the present invention, and the choice of loft angle 30 may depend upon various other design considerations, such as the choice of material and aesthetics.

Another such parameter in club design is the configuration of rear face 20. In a typical set of golf clubs, rear face 20 has either a "cavity back" configuration, i.e., a substantial portion of the mass of the club head is positioned on the back side around the perimeter 32 of the club head, or a "muscle back" configuration, where the mass of the club is relatively evenly distributed along the heel-to-toe length of body 12. Cavity back clubs tend to have larger sweet spots, lower centers of gravity, and higher inertia. In other words, cavity back clubs are easier to produce true hits. In long irons, the sweet spot can be difficult to hit accurately. Therefore, it is desirable for the long irons to have cavity back configurations. Another design for rear face 20 is a "channel back" which is similar to a cavity back with an undercut flange positioned near the sole to move the center of gravity rearward. Muscle back clubs tend to have relatively small sweet spots, higher centers of gravity, and lower inertia about shaft axis 18. If struck correctly, muscle back clubs often yield greater overall performance or workability due to the mass (or muscle) behind the sweet spot, but are more difficult to hit accurately by the average golfer due to the smaller sweet spot. As short irons tend to be easier to hit true for the average golfer, but workability can be lacking, it is desirable for the short irons to have muscle back characteristics.

According to one aspect of the present invention, as discussed in the parent '631 case, the performance continuum of the set is maximized by gradually transforming the configuration of rear face 20 from a predominantly channel back in the long irons to a muscle back in the short irons. According to another aspect of the present invention, as discussed in the parent '745 application and shown in FIGS. 2-7, the performance continuum of the set is maximized by gradually transforming the configuration of rear face 20 from an oversized channel back in the long irons to a standard-sized channel back in the short irons. The embodiment shown in FIGS. 2-7 and discussed in further detail below achieves this performance continuum in part by using a sandwich construction using a very thin hitting face insert (element 1017 in FIG. 4) reinforced with a lightweight core (element 1052 in FIG. 4) and a vibration dampener (element 1050 in FIG. 4). According to yet another aspect of the present invention, as can be seen in FIGS. 8A-C, the performance continuum of the set of clubs is maximized by gradually transforming from a channel back long iron with a rear face configuration having the characteristics of a cavity back club. The embodiment shown in FIGS. 8A-C achieves this performance continuum in part by providing a sandwich construction with a thin hitting face (element 1316 in FIG. 9), with or without a hitting face insert, and a mass control insert (element 1360 in FIG. 9) positioned behind the hitting face, where the weight of the mass control insert varies from heavier in the long irons to lighter in the short irons.

Additionally, a vibration dampening insert is incorporated into the channel back clubs. Further, the performance continuum is enhanced by having oversized club heads in the long irons, i.e., clubs heads that are larger or substantially larger than standard or traditional club heads, and gradually transitioning to mid-sized or standard-sized club heads in the short irons. In this manner, the long irons are relatively easier to hit accurately while the workability of the short irons is maintained.

Parent U.S. application Ser. No. 11/105,631, previously incorporated by reference, shows one embodiment of a set having a performance continuum. In that embodiment, the long irons have a cavity back configuration that is systematically transformed into a muscle back configuration in the short irons. In other words, as the clubs advance through the set, the configuration of the rear face begins as a cavity back in the longest iron, such as a 2-iron, develops muscle back traits in the mid-irons, such as having less mass on the perimeter of the club head, and finally becomes a muscle back configuration at or around the 8-iron. Table 1 details exemplary face area, exemplary offset, exemplary body length, and exemplary loft angle of the set in the '631 application as the set progresses from the long irons to the short irons.

TABLE 1

Exemplary Club Parameters from the '631 Application

| Iron Number | Loft Angle (degrees) | Cavity Volume ($in^3$) | Face Area ($in^2$) | Offset (in) | Top Line Width (in) | Center Sole Width (in) |
|---|---|---|---|---|---|---|
| 2 | 19 | 8.10 | 4.88 | 0.15 | 0.245 | 0.720 |
| 3 | 22 | 7.52 | 4.92 | 0.14 | 0.237 | 0.705 |
| 4 | 25 | 6.59 | 4.96 | 0.13 | 0.229 | 0.690 |
| 5 | 28 | 5.61 | 4.99 | 0.121 | 0.221 | 0.675 |
| 6 | 32 | 4.49 | 5.03 | 0.11 | 0.213 | 0.660 |
| 7 | 36 | 3.62 | 5.06 | 0.099 | 0.205 | 0.645 |
| 8 | 40 | NA | 5.11 | 0.09 | 0.197 | 0.630 |
| 9 | 44 | NA | 5.17 | 0.084 | 0.189 | 0.615 |
| PW | 48 | NA | 5.23 | 0.08 | 0.181 | 0.600 |

This systematic transition from cavity back clubs in the long irons of the set through transitional cavity-muscle backs in the mid-range irons to pure muscle back clubs in the short irons allows for a smoother performance continuum for the set taken as a whole. The long irons are made easier to hit correctly due to the cavity back design, and the short irons have improved performance due to the muscle back design.

As will be understood by those in the art, the location of the center of gravity may be altered through the set by other means, such as by including a dense insert, as described in co-owned, co-pending application Ser. No. 10/911,422 filed on Aug. 8, 2004, the disclosure of which is incorporated herein by reference in its entirety, or by otherwise altering the thickness or materials of hitting face 16 as described in U.S. Pat. No. 6,605,007, the disclosure of which is incorporated herein by reference.

Rotational moment of inertia ("inertia") in golf clubs is well known in art, and is fully discussed in many references, including U.S. Pat. No. 4,420,156, which is incorporated herein by reference in its entirety. When the inertia is too low, the club head tends to rotate more from off-center hits. Higher inertia indicates higher rotational mass and less rotation from off-center hits, thereby allowing off-center hits to fly farther and closer to the intended path. Inertia is measured about a vertical axis going through the center of gravity of the club head ($I_{yy}$), and about a horizontal axis going through the center of gravity (CG) of the club head ($I_{xx}$). The tendency of the club head to rotate around the y-axis through the CG indicates the amount of rotation that an off-center hit away from the y-axis causes. Similarly, the tendency of the club head to rotate in the around the x-axis through the CG indicates the amount of rotation that an off-center hit away from the x-axis through the CG causes. Most off-center hits cause a tendency to rotate around both x and y axes. High $I_{xx}$ and $I_{yy}$ reduce the tendency to rotate and provide more forgiveness to off-center hits.

Inertia is also measured about the shaft axis ($I_{sa}$). First, the face of the club is set in the address position, then the face is squared and the loft angle and the lie angle are set before measurements are taken. Any golf ball hit has a tendency to cause the club head to rotate around the shaft axis. An off-center hit toward the toe would produce the highest tendency to rotate about the shaft axis, and an off-center hit toward the heel causes the lowest. High $I_{sa}$ reduces the tendency to rotate and provides more control of the hitting face.

Also, Table 2, taken from the parent '631 application, shows how the systematic transition of the exemplary set parameters shown in Table 1 affect the exemplary centers of gravity and moments of inertia of the bodies systematically through the set. The center of gravity is measured from the ground while the club head is in the address position, which is. the position in which a golfer places the club with the sole of the club on the ground prior to beginning a swing.

TABLE 2

Center of Gravity and Inertial Moments from the '631 Application

| Iron Number | CG from Ground (mm) | Moment of Inertia ($I_{xx}$) | Moment of Inertia ($I_{yy}$) | Moment of Inertia ($I_{sa}$) |
|---|---|---|---|---|
| 2 | 17.00 | 46.5 | 211 | 453 |
| 3 | 17.20 | 47.0 | 211 | 464 |
| 4 | 17.40 | 48.7 | 211 | 477 |
| 5 | 17.60 | 49.0 | 214 | 498 |
| 6 | 17.80 | 50.0 | 217 | 511 |
| 7 | 18.00 | 51.5 | 221 | 529 |
| 8 | 18.20 | 60.4 | 225 | 534 |
| 9 | 18.40 | 64.0 | 231 | 545 |
| PW | 18.60 | 65.9 | 234 | 561 |

FIGS. 2-7 show another embodiment of a club set having a performance continuum through the set, as shown and discussed in parent U.S. application Ser. No. 11/193,745, previously incorporated by reference. Various design parameters of the club head of the set systematically vary in the progression through the set in order to provide a continuum of performance and aesthetics. In the embodiment shown in FIGS. 2-7, the club heads 1010, 1110, 1210 preferably progress from an oversized channel back in the long irons (shown in FIGS. 2-5), through a mid-sized channel back in the mid-irons (shown in FIG. 6), and finally to a standard-sized cavity back in the short irons (shown in FIG. 7). In another embodiment, all clubs of the set may have an oversized, mid-sized, or standard-sized hitting face 16, or any combination thereof.

Figure 2:
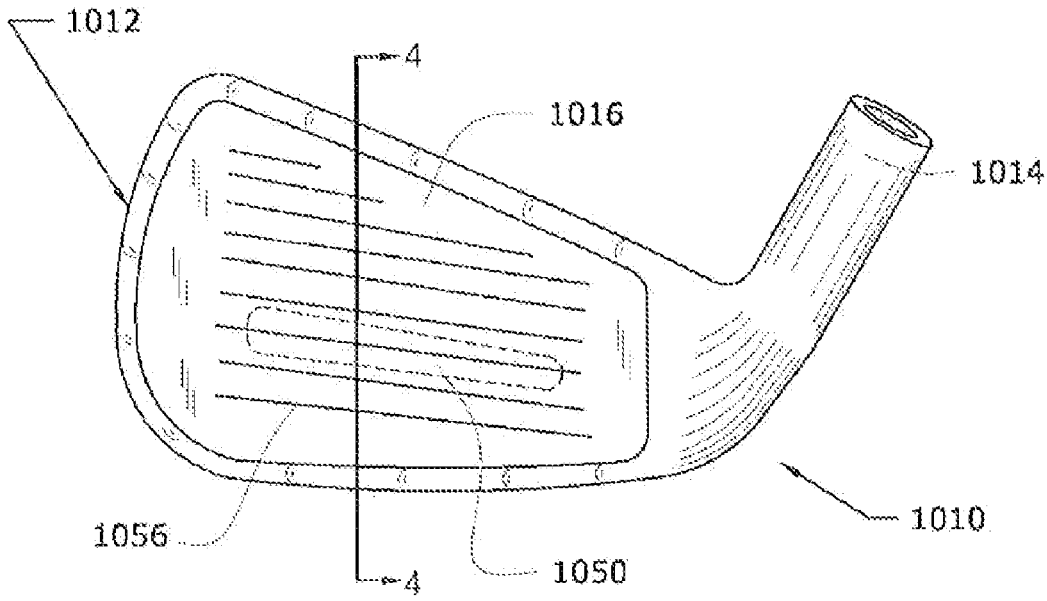
FIG. 2 is a front view of a club head having a vibration dampener.
Figure 3:
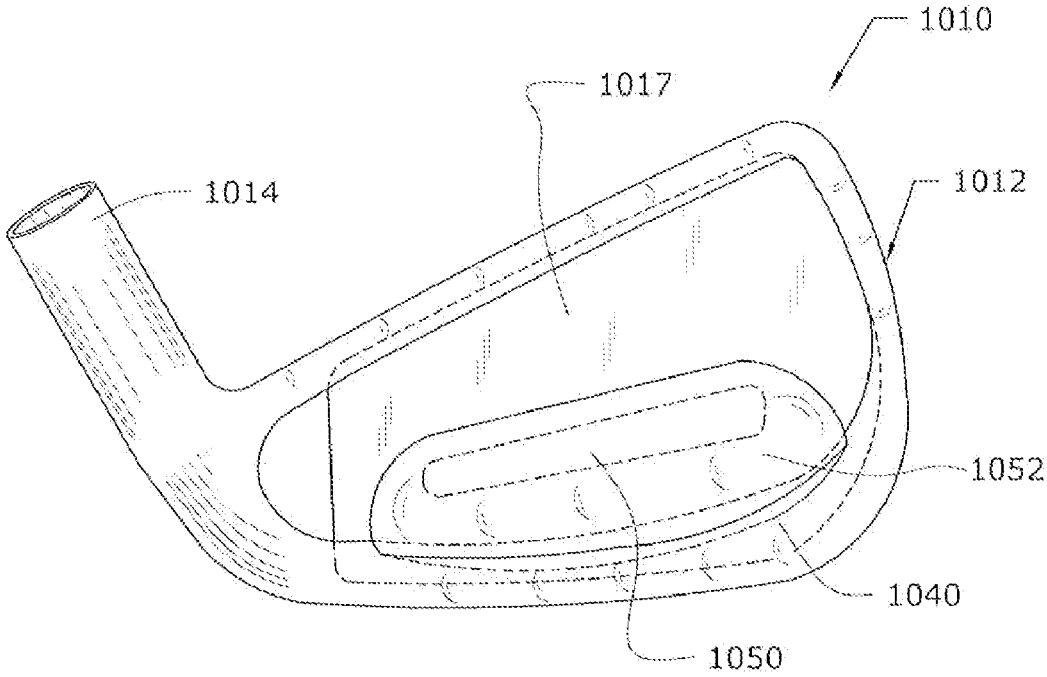
FIG. 3 is a rear view of the club head of FIG. 2.
Figure 4:
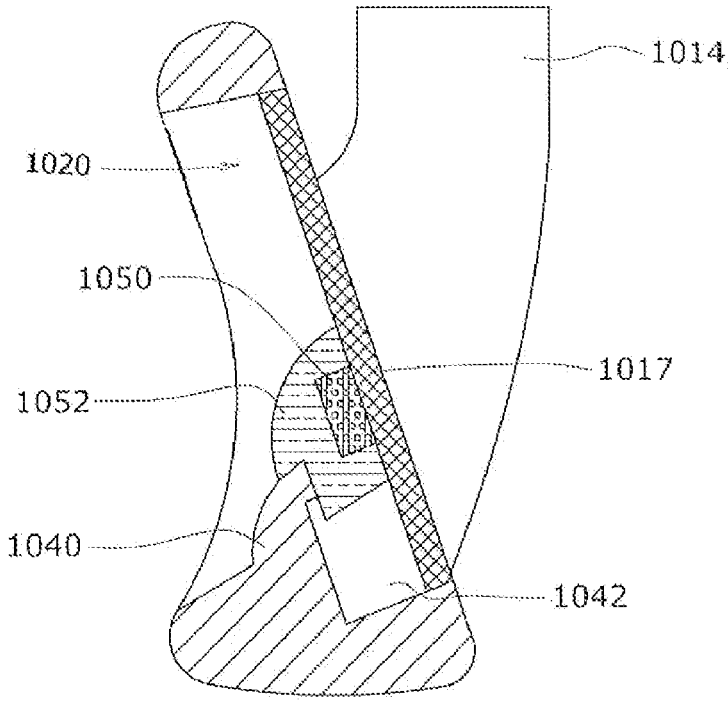
FIG. 4 is a cross-sectional view of the club head of FIG. 2 taken along line 4-4 thereof showing the vibration dampener.
Figure 4A:
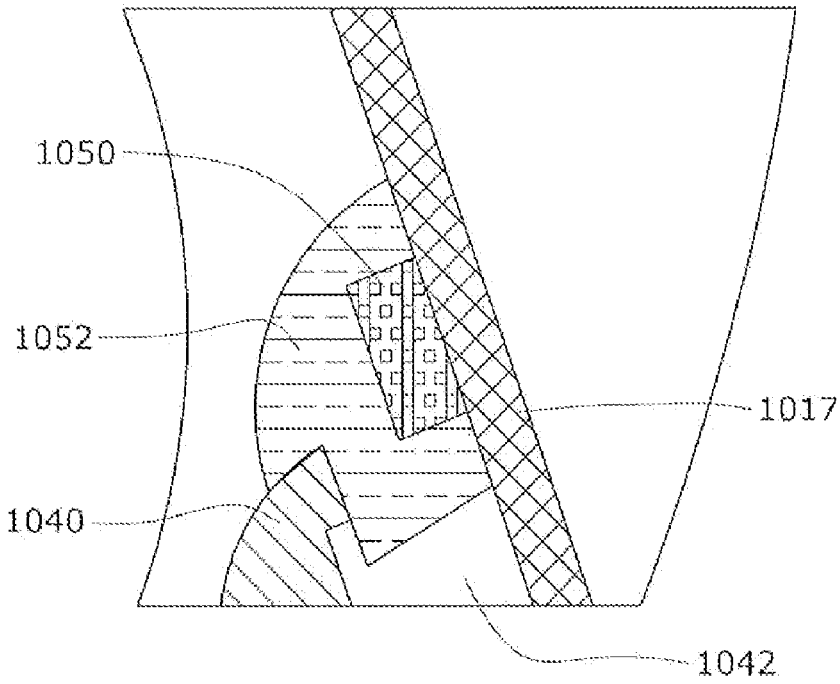
FIG. 4*a* is an enlarged cross-sectional view of the vibration dampener of FIG. 4.

FIGS. 2-5 show a club head 1010 of a long iron, preferably a 2-, 3-, or 4-iron using common numbering. FIG. 2 is a front view of a club head 1010 having a hosel 1014 connected to a body 1012 at a loft angle 1030. In the long irons, loft angle 1030 preferably ranges from about 18 degrees to about 27 degrees. FIG. 3 shows a body 1012 that includes a hitting face 1016. The configuration of rear face 1020 of club head 1010 as shown in FIG. 3 is shown in FIGS. 4 and **4*a* and is preferably of the type known in the art as a "channel back", where a channel 1042 is defined by a flange 1040 in the sole portion of club head 1010. As shown, a channel back is used in combination with a cavity back design. Club head 1010 may be made from any material known in the art and by any method known in the art. Preferably, however, club head 1010** is forged from stainless steel, or forged from carbon steel and chrome plated, or made from titanium. Further discussion of this and other manufacturing methods and appropriate materials may be found in co-owned, co-pending application Ser. No. 10/640,537 filed on Aug. 13, 2003, the disclosure of which is incorporated herein by reference.

A shown in FIGS. 4, **4*a*, and 5, hitting face 1016 preferably has a sandwich-type construction that includes a hitting face insert 1017, a dampening element 1050, and a lightweight core 1052 for reinforcing hitting face insert 1017. Hitting face insert 1017 is preferably thin and light weight, so as to redistribute the weight of hitting face 1016 to flange 1040, and strong, so as to withstand the repeated impacts. This sandwich-type construction allows for hitting face insert 1017 to be very thin, as core 1052 reinforces the impact zone of 1017. As hitting face 1017 is thin, and, therefore, lighter than a conventional hitting face made of a thicker material, the center of gravity of club head 1010 is moved aft, which results in higher ball flight. Dampening element 1050 helps to improve the vibration characteristics of club head 1010**.

Hitting face insert 1017 is preferably made from a low weight material having a density of less than about 5 g/cc and a hardness ranging from about 20 to about 60 on the Rockwell Hardness C scale (HRC). Appropriate materials include titanium, titanium alloys, plastic, urethane, and magnesium. More preferably, the hardness of hitting face insert 1017 is about 40 on the HRC. Hitting face insert 1017 is preferably sized to be press fit into a corresponding void in hitting face 1016 and secured therewithin using any method known in the art, such as an adhesive or welding. A front side of hitting face insert 1017 preferably includes surface textures, such as a roughened face and a succession of grooves 1056 (shown in FIGS. 2 and 5). Hitting face insert may be made by any method known in the art, such as by machining sheet metal, forging, casting, or the like.

As hitting face insert 1017 is thin, core 1052 is disposed behind hitting face insert 1017 to reinforce hitting face insert 1017. Core 1052 is preferably made from a lightweight material such as aluminum. Core 1052 is configured to be at least partially inserted into channel 1042, which is preferably hollow, such as by press fitting, and is also preferably affixed within channel 1042 and to hitting face insert 1017, for example with an adhesive, such as epoxy. In another embodiment, channel 1042 may be filled with the epoxy or another material such as foam.

Dampening element 1050 is disposed between hitting face insert 1017 and core 1052. Dampening element 1050 may be any type of resilient material known in the art for dampening vibrations such as rubber or urethane having a hardness of about 60 on the Rockwell Hardness Shore A scale (HRA). Dampening element 1050 may be any visco-elastic material. Dampening element 1050 is preferably configured to be press fit into a void (not shown) formed in core 1052 and securing it therewithin with an adhesive such as epoxy. Preferably, dampening element 1050 is generally quadrilateral in shape, with the surface area of one of the faces of dampening element 1050 ranging from about 0.1 inch$^2$ to about 2.5 in$^2$, and more preferably between about 0.15 in$^2$ and about 1.2 in$^2$. The thickness of dampening element 1050 preferably ranges from about 0.050 in to about 0.45 in, and is preferably about 0.1 in. As will be recognized by those in the art, the dimensions of dampening insert 1050 chosen for any particular club head will depend upon many factors, including the area of the hitting face and the material of the dampening element. Dampening element 1050 is preferably located behind hitting face insert 1017 at the point of most likely ball impact, such as about 0.75 in above the sole. Dampening element 1050 absorbs a portion of the shock of impact to reduce vibrations of the club for a better feel during play.

As will be apparent to those in the art, the use of this sandwich-type configuration to provide hitting face reinforcement and dampening is appropriate for use in any iron-type club. Additionally, dampening element 1050 and core 1052 may be used without hitting face insert 1017, i.e., placed directly behind a unitary piece hitting face 1016. However, as in the preferred set the club heads transition from channel back in the long irons to conventional cavity backs in the short irons, the use of the sandwich-type configuration with a hitting face insert 1017 is preferably confined to the long irons.

Figure 6:
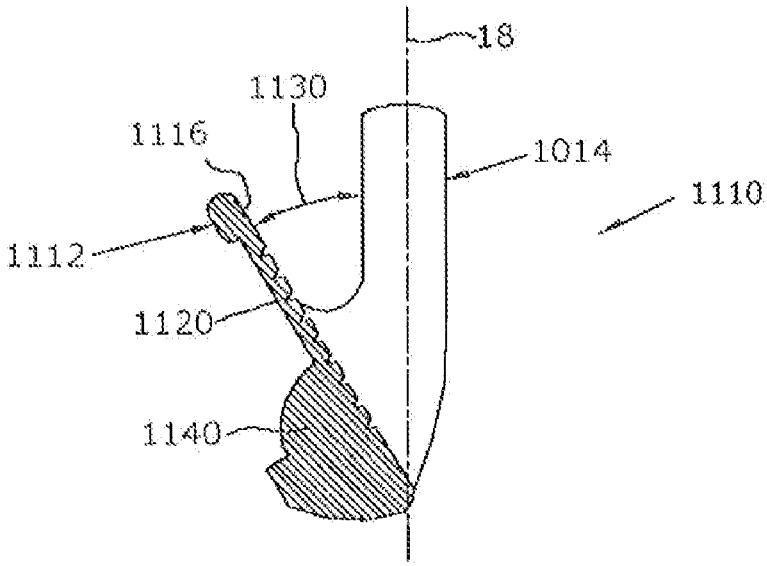
FIG. 6 shows a cross-sectional view of a mid iron according to the embodiment of FIG. 2.

A mid-iron club head 1110 design is shown in FIG. 6. In club head 1110, a hosel 1114 is attached to a body 1112 at a loft angle 1130. Loft angle 1130 preferably ranges from about 27 degrees to about 40 degrees, more preferably from about 29 degrees to about 37 degrees. Club head 1110 is preferably formed as a unitary piece from a material such as forged stainless steel or titanium. In other words, since the center of gravity may be higher in the mid-iron clubs, light weight hitting face insert or sandwich-type construction may be omitted. However, in another embodiment, hitting face 1116 may be thinned and a sandwich-type construction may be used, although preferably no hitting face insert is provided. Preferably, in the mid-iron clubs of the set, the volumes of the rear cavities are less than those of the short irons, as the cavity volumes progress through the set to contribute to the performance continuum, as discussed above.

Figure 7:
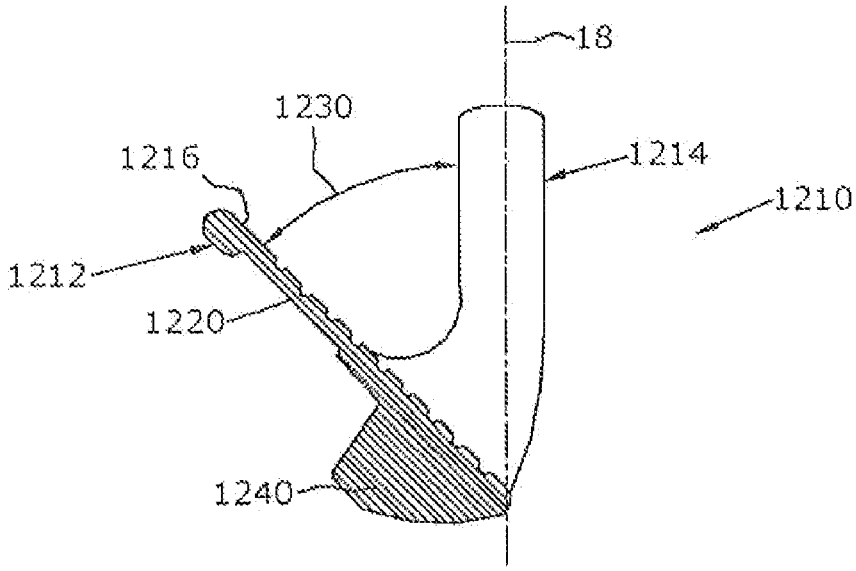
FIG. 7 shows a cross-sectional view of a short iron according to the embodiment of FIG. 2.
Figure 8A:
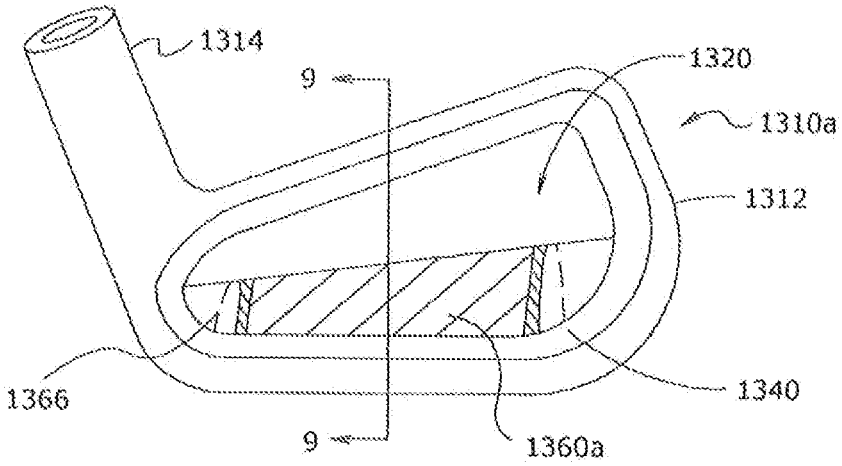
FIGS. 8A, 8B and 8C are partially cut away rear views of short, mid- and long iron club heads, respectively, of a set of clubs where each club has a mass control insert according to an embodiment of the present invention.
Figure 8B:
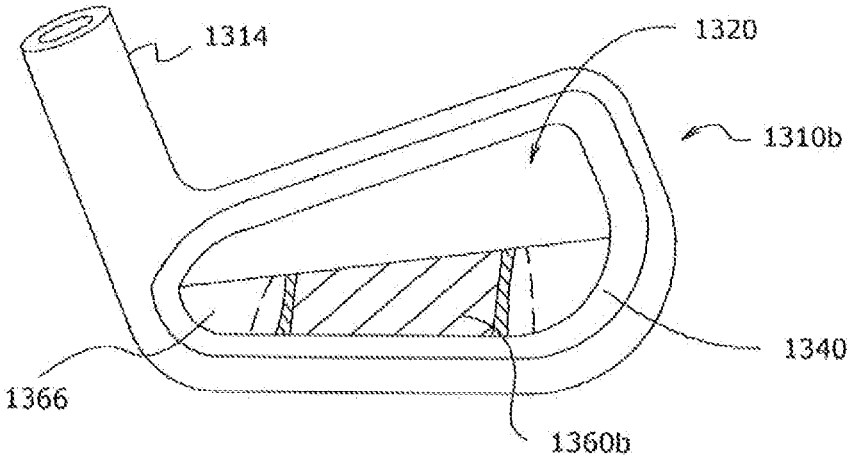
Figure 8C:
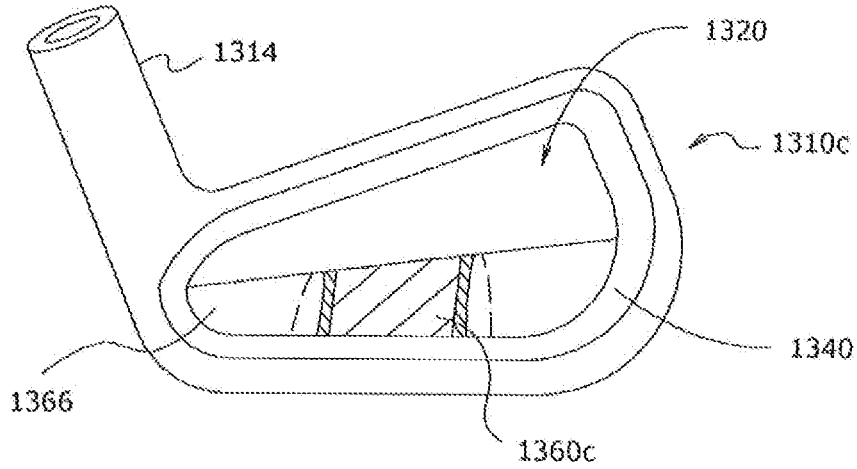

A short-iron club head 1210 design is shown in FIG. 7. In club head 1210, a hosel 1214 is attached to a body 1212 at a loft angle 1230. Loft angle 1230 preferably ranges from about 40 degrees to about 52 degrees, more preferably from about 41 degrees to about 50 degrees. Similar to club head 1110 discussed with respect to FIG. 6 above, club head 1210 is preferably formed as a unitary piece from a material such as forged stainless steel or titanium. Again, while a muscle back or a channel such as channel 1042 may be provided, preferably club head 1210 is a traditional cavity back design. Preferably, in the short irons, the volumes of the rear cavities are less than those of the mid-irons, as the cavity volumes progress through the set to contribute to the performance continuum as discussed above.

In this embodiment, the area of hitting face 1016, 1116, 1216 is preferably substantially constant through the set. However, in addition to varying the club head type through the set, other design parameters are also preferably systematically varied through the set to yield maximum performance results from the set, as shown in Table 3.

TABLE 3

Exemplary Club Parameters From the '745 Application

| Parameter | 2-Iron | Pitching Wedge |
|---|---|---|
| Face Area (in$^2$) | 5.6 | 5.6 |
| Face Thickness (in) | 0.080 | 0.120 |
| Face Hardness | HRC 50 | HRB 70 |
| Cavity Volume (in$^3$) | 1.47 | 0.33 |
| Top Line Width (in) | 0.350 | 0.242 |
| Hosel Length (in) | 2.2 | 2.7 |
| Grooves, depth (in) | 0.025 | 0.035 |
| Grooves, type | V | U |
| Sole, width (in) | 0.79 | 0.65 |

These design parameters are preferably varied approximately linearly through the set. Similar equations for the example design of Table 3 may be expressed for each design parameter shown in Table 3, as discussed in the parent '745 application, previously incorporated by reference.

Figure 5:
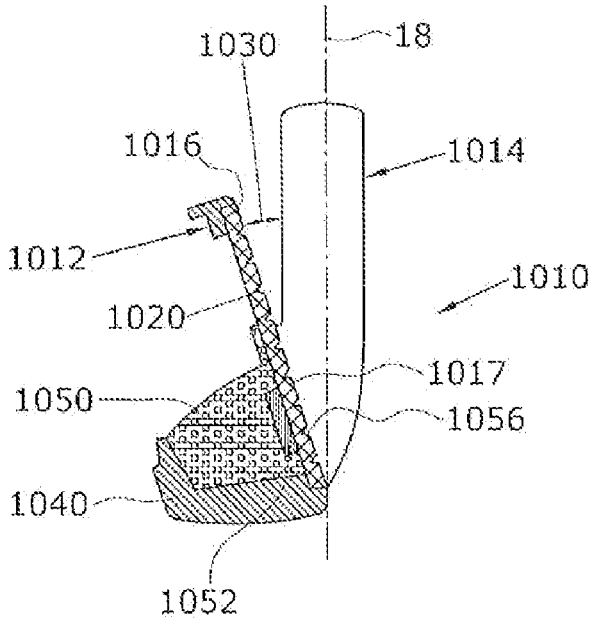
FIG. 5 shows a cross-sectional view of a long iron according to an embodiment of the present invention.

In another embodiment, shown in FIGS. 8A-C and 9, the sandwich construction shown in FIGS. 3-5 may be used for mass distribution control. In this embodiment, any of the iron-type club heads 1310*a-c* include a body 1312 having a hosel 1314 and a rear face 1320. Rear face 1320 is opposite a hitting face 1316, shown in FIG. 9. Body 1312 and hitting face 1316 are preferably a unitary piece, such as a forged stainless steel or cast titanium piece. However, as discussed above with respect to FIGS. 3-5, hitting face 1316 may include a hitting face insert (not shown) made from a different material or a very thin piece of the same material as the rest of body 1312.

Rear face 1320 preferably has a channel back construction similar to that of the embodiment shown above with respect to FIGS. 3-5, where a channel 1342 is defined between hitting face 1316 and a lower flange 1340. Preferably, at least a portion of a mass control insert 1360 is positioned within channel 1342, essentially nestled between the back of hitting face 1316 and lower flange 1342. Mass control insert 1360 may be made from any material known in the art, including but not limited to aluminum, titanium, plastic, magnesium, steel, tungsten and various composites or alloys of these and other materials. The density of the material of mass control insert 1360 is preferably either greater or lower than that of the material of body 1312. For example, if body 1312 is made of forged stainless steel, mass control insert 1360 may be made from aluminum or titanium, both of which are materials with significantly lower densities than that of steel. In this case, the mass of club head 1310 is shifted toward the perimeter thereof. Alternatively, if body 1312 is made of forged stainless steel, mass control insert 1360 may be made from tungsten to increase the mass behind hitting face 1316.

Figure 9:
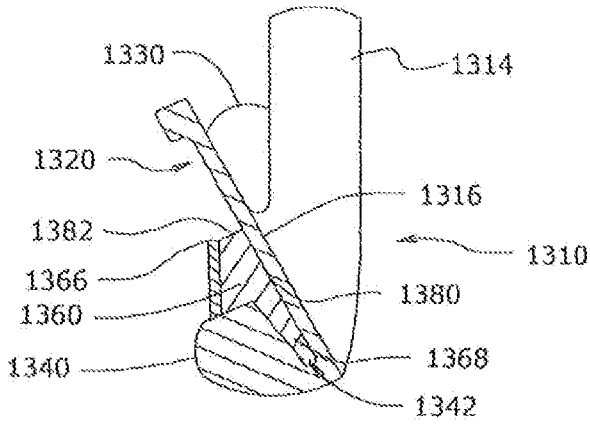
FIG. 9 is a cross-sectional view of the club head of FIG. 8A taken along line 9-9 thereof.

Mass control insert 1360 is preferably affixed within channel 1342 and to the rear surface of hitting face 1316 by any means known in the art such as welding or with an adhesive. Epoxy may be used, and the epoxy layer can also serve as a vibration dampening element. Furthermore, an optional plate-like cover 1366, as shown in FIG. 9, encloses mass control insert 1360 so that mass control insert 1360 may be protected if made from a softer or brittle material. Plate-like cover 1366 is preferably made from the same material as that of body 1310 and affixed to rear face 1320 by any means known in the art, such as welding or with an adhesive.

Mass control insert 1360 reinforces hitting face 1316 so that hitting face 1316 may be made very thin so that the mass of club head 1310 may be distributed to the edges and bottom thereof. Mass control insert 1360 gives the club design the ability to fine tune the properties of club head 1310, discussed above. A dampening element (not shown), similar to dampening element 1050 discussed above with respect to FIGS. 3-5, may optionally be positioned between mass control insert 1360 and hitting face 1316.

FIGS. 8A-C show three club heads 1310*a-c* in a set of clubs; FIG. 8A is the club head of a long iron such as a 2-,3-, or 4-iron, FIG. 8B is the club head of a mid-iron such as a 5-, 6-, or 7-iron, and FIG. 8C is the club head of a short iron, such as an 8- or 9-iron or a pitching wedge. Preferably, mass control insert 1360*a-c* varies systematically through the set to maximize mass distribution properties for the type of club while maintaining a uniform aesthetic look and feel through the set. The systematic variation is to control the mass shifted to the perimeter. The variation can be achieved in many ways, such as using different materials for mass control insert 1360 or using the same material for mass control insert 1360 throughout the set while varying the volume of insert 1360 such as by changing the length.

In the embodiment shown in FIGS. 8A-C, mass control insert 1360*a-c* is made of a material less dense than that of body 1312 and the same material is used for mass control insert 1360*a-c* through the set. In the long irons, as shown in FIG. 8A, mass control insert 1360*a* extends along much of the length of flange 1340. In the mid-irons, as shown in FIG. 8B, mass control insert 1360*b* has less length, and therefore a lower volume, than that of mass control insert 1360*a*. Consequently, less mass is distributed toward the perimeter of mid-iron club head 1310*b* than is shifted toward the perimeter and bottom in long iron club head 1310*a*. In the short irons, as shown in FIG. 8C, mass control insert 1360*c* has less length, and therefore a lower volume, than that of either mass control insert 1360*a* or mass control insert 1360*b*. Consequently, even less mass is distributed toward the perimeter and bottom of short iron club head 1310*c* than is shifted toward the perimeter and bottom in mid-iron club head 1310*b*.

Therefore, while maintaining continuity of look and hitting feel through the set, desirable characteristics of individual clubs may be maximized. With a large amount of the mass distributed to the perimeter of club head 1310*a*, the playability of the long irons can be maximized, with greater forgiveness and longer flight. In other words, club head 1310*a* plays like a cavity back club having a relatively large cavity. Similarly, with less of the mass distributed to the perimeter of club head 1310*c*, the shot control of the short irons can be maximized. In other words, club head 1310*c* plays more like a muscle back club. In another embodiment, the same insert 1360 may be used with all clubs; in other words, in such an embodiment, mass control insert 1360 does not vary through the set.

Preferably at least one additional club design parameter also varies systematically through the set with loft angle as described herein with respect to FIGS. 1-7. The systematically varying club design parameters may include offset as set forth in Table 4, face area as set forth in Table 3, top line width as set forth in Table 3, sole width as set forth in Table 3, center of gravity from ground as set forth in Table 2, depth of the center of gravity as set forth in Table 5, hitting face hardness as set forth in Table 3, club head face thickness as set forth in Table 3, hitting face surface texture roughness as set forth in the parent '745 patent, or groove geometry as set forth in Table 3. Several of these parameters will be discussed in additional detail below in the example. Additionally, preferably at least one of the clubs in the set has an oversized club head, preferably one of the long irons.

Figure 10:
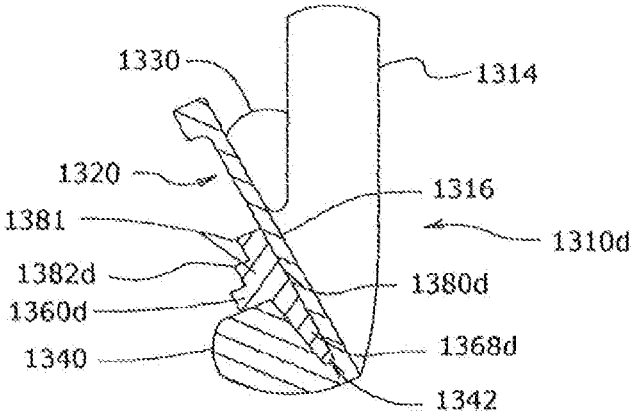
FIG. 10 is a cross-sectional view of an alternate embodiment of the club head of FIG. 8A.

FIG. 9 is a cross-sectional view of club head 1310 from FIGS. 8A-C, taken along line 9-9 in FIG. 8A, to show a general shape of mass control insert 1360. In this embodiment, mass control insert 1360 has a lower tail 1368 that completely fills channel 1342. A front edge 1380 is angled to be flush against the rear surface of hitting face 1316, while a rear edge 1382 of mass control insert 1360 is also smooth and extends over flange 1340. However, many other configurations are appropriate for use in the present invention. FIG. 10 shows an alternate configuration, where tail 1368*d* completely fills channel 1342 and front edge 1380*d* is smooth to be flush against the rear surface of hitting face 1316 like in FIG. 9. However, rear edge 1382*d* is not smooth, but includes step-like ridges 1381 to increase the mass at the bottom of mass control insert 1360*d*, which provides additional reinforcement of hitting face 1316 in that region.

Figure 11:
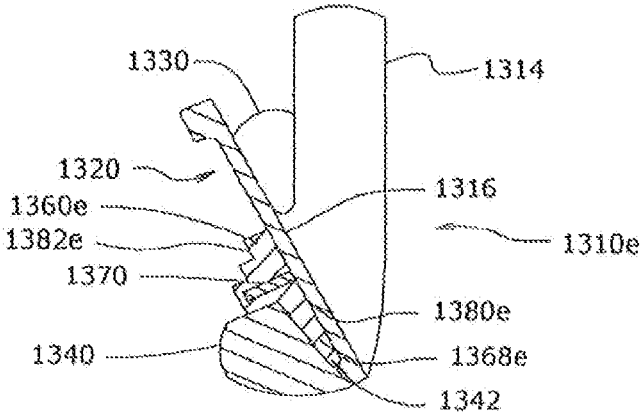
FIG. 11 is a cross-sectional view of an alternate embodiment of the club head of FIG. 8A.

Another embodiment is shown in FIG. 11, where a club head 1310*e* includes a hitting face insert 1360*e* which is similar to insert 1360*d*, except that a secondary insert 1370 is disposed within mass control insert 1360*d*. Secondary insert 1370 is preferably slug of material of high density, such as tungsten or tungsten-loaded plastic. Varying the density of secondary insert 1370 through the set provides an additional level of control over the mass distribution properties of the set.

Figure 12:
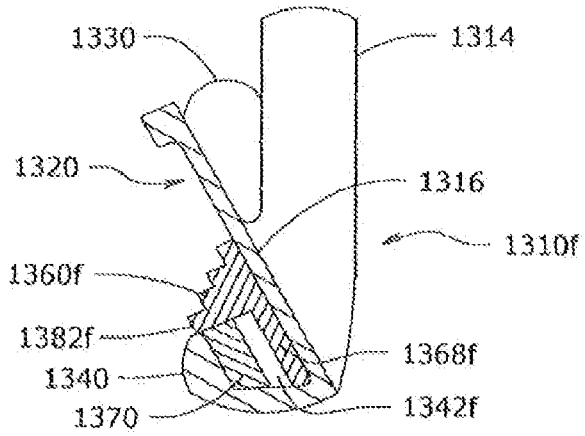
FIG. 12 is a cross-sectional view of an alternate embodiment of the club head of FIG. 8A.

Another embodiment is shown in FIG. 12, where a club head 1310*f* has a larger channel 1342*f* than those of club heads 1310*a-d*. Mass control insert 1360*f* has a lower tail 1368*f* that does not completely fill channel 1342*f*. Also, rear edge 1382*f* extends over flange 1340, but does not enter channel 1342*f*. A secondary insert 1370*f*, similar to secondary insert 1370 described above with respect to FIG. 12, is disposed within a portion of channel 1342*f* while the remainder of channel 1342*f* is a void. Alternatively, secondary insert 1370*f* is formed unitary with insert 1360*f*.

Figure 13:
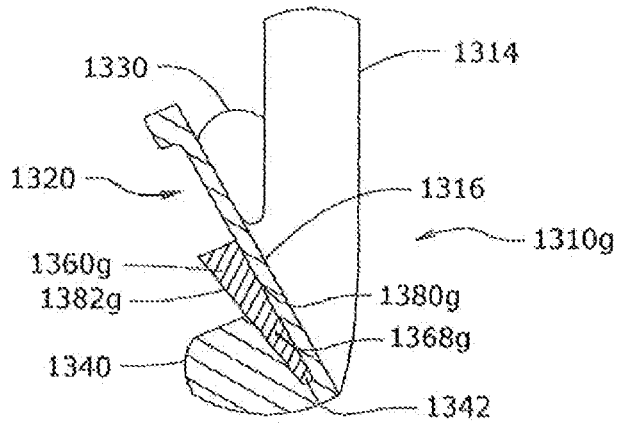
FIG. 13 is a cross-sectional view of an alternate embodiment of the club head of FIG. 8A.

Yet another embodiment is shown in FIG. 13, where a club head 1310*g* is similar in configuration to club heads 1310*a-d* as shown in FIGS. 8A-C and discussed above. In this embodiment, a mass control insert 1360*g* includes a tail 1368*g* and rear edge 1382*g*, which forms a continuous smooth surface such that no portion of rear edge extends over and is in contact with flange 1340.

Figure 14:
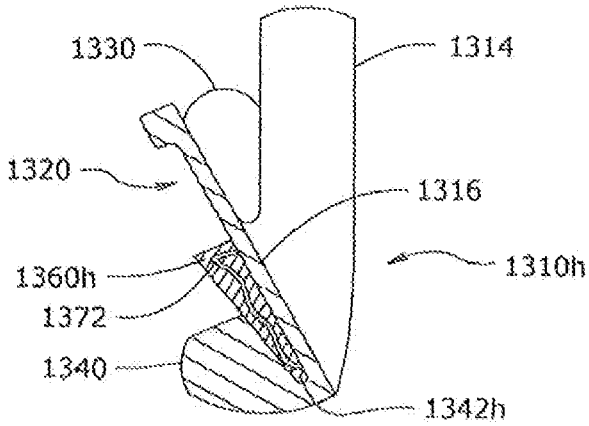
FIG. 14 is a cross-sectional view of an alternate embodiment of the club head of FIG. 8A.

Yet another embodiment is shown in FIG. 14, where a mass control insert 1360*h* is similar to mass control insert 1360*g* as shown in FIG. 13. However, mass control insert 1360*h* has a void 1372 formed therein. Void 1372 may be filled with materials of varying density through the set, or else it may be left empty. The size of void 1372 may also be varied to manipulate the mass of mass control insert 1360*h* through the set.

Figure 15A:
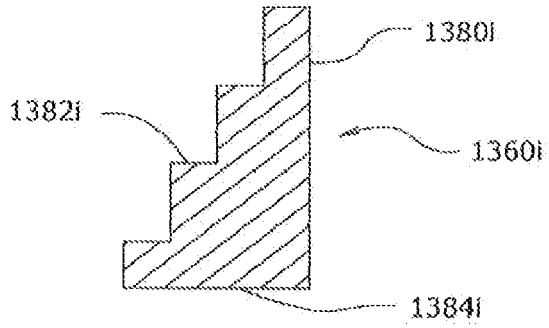
FIGS. 15A-E are cross-sectional views of alternate embodiments of inserts for use in the club heads of FIGS. 8A-C.
Figure 15B:
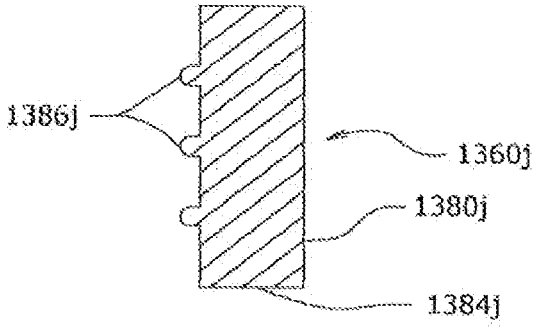
Figure 15D:
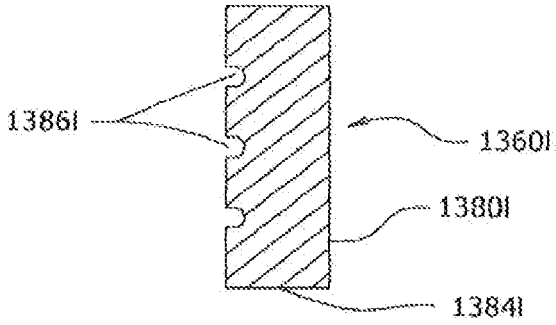
Figure 15E:
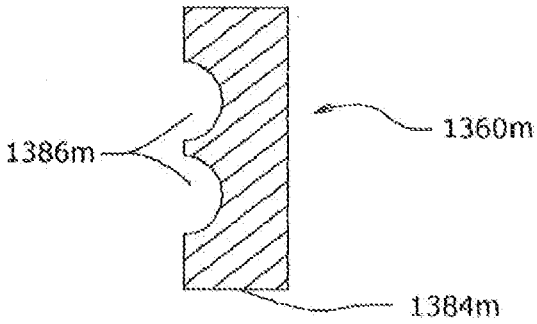
Figure 15C:
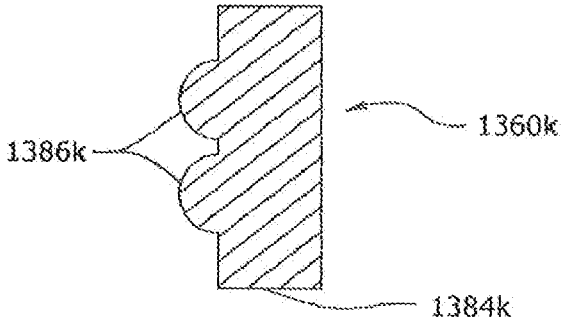

FIGS. 15A-E show additional embodiments of mass control inserts 1360*i-m*, each having a flat bottom surface 1384*i-m* in lieu of a tail. Flat bottom surface 1384*i-m* preferably is not inserted into channel 1342, thereby leaving channel 1342 as a void. Also, each of mass control inserts 1360*i-m* include rear edges 1382*i-m* having non-smooth configurations. Mass control insert 1360*i* as shown in FIG. 15A is similar to mass control insert 1360*d* shown in FIG. 10 above, where rear edge 1382*i* includes steps. Mass control inserts 1360*j* as shown in FIG. 15B and 1360*k* as shown in FIG. 15C include protruding ribs 1386*j*, 1386*k*. Mass control inserts 1360*l* as shown in FIG. 15D and 1360*m* as shown in FIG. 15E include indentations 1386*l*, 1386*m*.

Figure 16A:
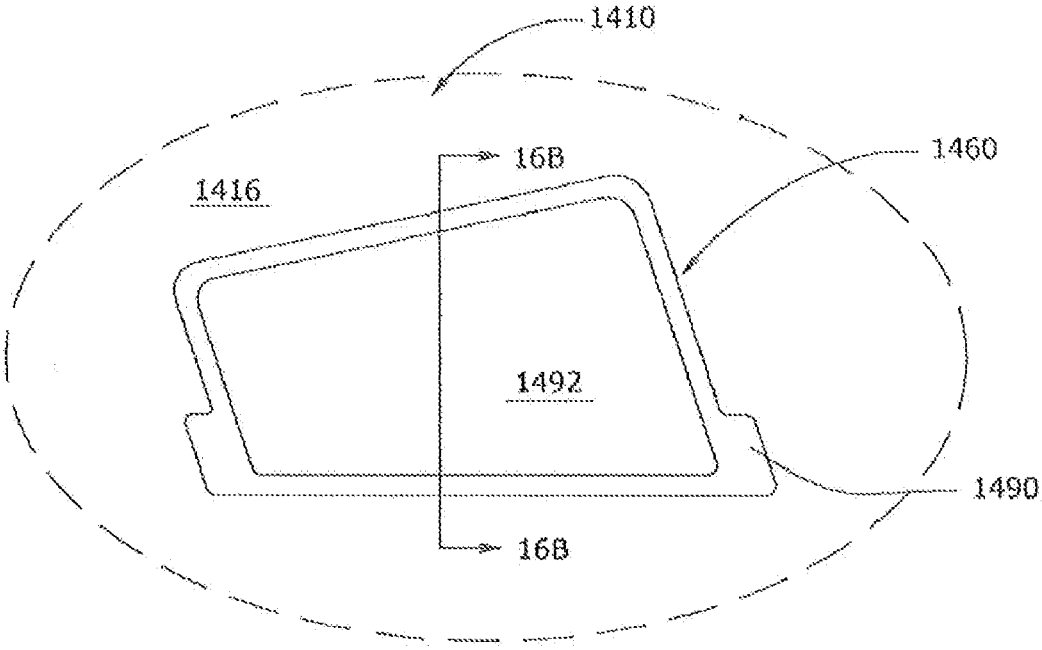
FIG. 16A is an enlarged partial view of a club head with a mass control insert according to another embodiment of the present invention.
Figure 16B:
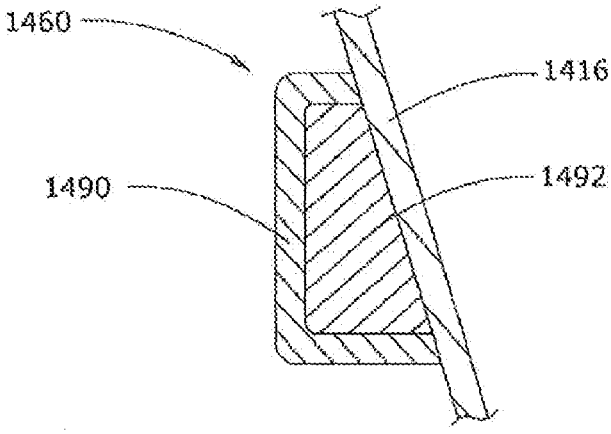
FIG. 16B is a partial cross-sectional view of the club head of FIG. 16A taken along line 16B-16B thereof.

Yet another embodiment of a mass control insert 1460 affixed to a rear surface of a hitting face 1416 of a golf club head 1410 is shown in FIGS. 16A and 16B. In this embodiment, mass control insert 1460 includes two pieces, a lightweight shell 1490 and a dense insert 1492. Lightweight shell 1490 and dense insert 1492 are affixed to hitting face 1416 by any method known in the art, such as with an adhesive, welding, or by using tabs or flanges to secure mass control insert to hitting face 1416. As shown in FIG. 16B, mass control insert 1460 is preferably affixed to hitting face 1416 such that dense insert 1492 is flush against a rear surface of hitting face 1416 while lightweight shell 1490 forms a cover over dense insert 1492. As such, only lightweight shell 1490 is visible when club head 1410 is fully assembled.

Preferably, lightweight shell 1490 is made from a plastic or polymeric material or a low density metal, such as aluminum. Lightweight shell 1490 is a relatively thin-walled piece configured to receive dense insert 1492 in a central portion such that lightweight shell 1490 essentially surrounds dense insert 1492 on three sides. Lightweight shell 1490 may be manufactured by any method known in the art, such as injection molding if a plastic material is used or forging or stamping if a metal is used. As lightweight shell 1490 is visible when club head 1410 is assembled, lightweight shell 1490 is preferably made to be aesthetically pleasing, such as with the application of a surface treatment such as a paint or other coating or a texture, such as a stamped logo, a color included in the material, or the like.

Dense insert 1492 is sized and configured to be inserted within lightweight shell 1490. Dense insert 1492 may be affixed within lightweight shell 1490 by any method known in the art, such as with an adhesive or by welding. Alternatively, dense insert 1492 may be affixed only to hitting face 1416, with lightweight shell 1490 also affixed only to hitting face 1416.

Dense insert 1492 is preferably made from a material whose density is less than that of the material forming hitting face 1416 so that mass control insert 1460 is still displacing mass in the central portion of hitting face 1416 to the perimeter thereof. While any material known in the art may be appropriate for dense insert, the density of the material of dense insert 1492 is preferably easily varied so that, in production, several different densities of dense insert 1492 may be easily manufactured. Such a material is tungsten loaded plastic, where the density of the overall material is altered depending upon the amount of tungsten added to the plastic matrix. Preferably, dense insert 1492 is made from tungsten loaded plastic having a density between about 1.5 g/cc and about 11 g/cc for an overall weight for mass control insert of between about 2 g and about 9 g. Other appropriate materials for dense insert 1492 include aluminum and tungsten.

An advantage to having multiple density dense inserts 1492 readily available is the ability to customize a club head easily to adjust the overall club head weight based on customer preference. For example, club head 1410 may be sent to a pro shop, tour van, or similar point of sale and/or distribution with lightweight shells 1490 and various densities of inserts 1492 provided separately along with materials for affixing lightweight shells 1490 and dense inserts 1492 to club head 1410, such as epoxy. The customer can then try the different densities to select a preferred density for dense insert 1492. For example, club head 1410 may be provided with a slot on the rear surface of hitting face 1416 capable of temporarily holding mass control insert 1460 in place while various densities are tested by the customer, test clubs with differing mass control inserts 1460 may also be provided, or equipment for removing the epoxy or similar adhesive used to affix mass control insert 1460 to hitting face 1416 may be provided. Once the customer selects the preferred mass control insert 1460, an on-site technician can affix the selected mass control insert 1460 to club head 1410. Furthermore, a specific lightweight shell 1490 may also be selected, providing, for example, different colors, logos, or other aesthetics. As will be recognized by those in the art, this customization capability can also be used with any of the mass control inserts described herein.

EXAMPLE: An inventive set of three clubs, a 3-iron, a 6-iron, and a 9-iron, was manufactured according to the embodiment shown in FIGS. 8A-C. The club bodies were made from forged stainless steel, and the mass control inserts were made from aluminum. The height, width and position of the mass control inserts were held constant through the set, but the length, and therefore the volume, of the mass control inserts were varied systematically through the set. In one preferred embodiment the mass of the insert decreases progressively throughout the set, e.g., the largest mass control insert by volume was placed in the 3-iron, the next largest mass control insert by volume was placed in the 6-iron, and the smallest mass control insert by volume was placed in the 9-iron. In this example, the mass of the insert varies through the set as set forth in Table 4. The clubs were designed so that many parameters were varied systematically through the set, including loft angle, face area, and offset. A summary of selected design parameters is shown in Table 4 below.

TABLE 4

Inventive Club Set With Mass Insert

| Design Parameter | Inventive Club Head Number 3-Iron | 6-Iron | 9-Iron |
|---|---|---|---|
| Loft Angle (deg) | 22 | 32 | 44 |
| Face Area ($in^2$) | 4.47 | 4.53 | 4.73 |
| Top Line Width (in) | 0.245 | 0.230 | 0.215 |
| Offset (in) | 0.160 | 0.120 | 0.100 |
| Sole Width, Center (in) | 0.725 | 0.680 | 0.635 |
| Insert weight (g) | 5.15 | 3.75 | 4.09 |
| Insert volume (cc) | 1.84 | 1.34 | 1.46 |

The inserts disclosed in Table 4 are made from aluminum (density of 2.8 g/cc). In a full set of iron clubs, the 5.15 g insert is also used in the 2-iron and the 4-iron. The 3.75 g insert is also used in the 5-iron and the 7-iron, and the 4.09 g insert is also used in the 8-iron and the pitching wedge.

Using mass control insert 1360 to manipulate or fine-tune the distribution of mass within the club head can be seen in Table 5. The depth of the CG and the CG on the shaft axis are both shifted by using mass insert 1360.

TABLE 5

Inventive Club Set with Mass Insert CG and MOI Properties

| Club Head Parameter | Comparative 3-Iron, No Insert | Inventive 3-Iron | Inventive 6-Iron | Inventive 9-Iron |
|---|---|---|---|---|
| Center of Gravity, Ground (mm) | 18.2 | 18.2 | 18.1 | 18.0 |
| Center of Gravity, Shaft Axis (mm) | 33.5 | 33.6 | 34.6 | 33.8 |
| Center of Gravity, Depth (mm) | 7.1 | 7.2 | 8.7 | 11.3 |
| Moment of Inertia, $I_{yy}$, | 211 | 215 | 222 | 243 |
| Moment of Inertia, $I_{xx}$ | 50 | 50 | 52 | 63 |
| Moment of Inertia, $I_{zz}$ | 246 | 250 | 251 | 264 |
| Moment of Inertia, Total | 328 | 333 | 339 | 364 |
| Moment of Inertia, $I_{sa}$ | 439 | 445 | 504 | 550 |

Groove geometry may be varied to affect spin performance, such as is discussed in U.S. Pat. No. 5,591,092, the disclosure of which is hereby incorporated by reference in its entirety. A front side of hitting face insert 1017 preferably includes surface textures, such as a roughened face and a succession of grooves 1056 (shown in FIGS. 2 and 5-7). The design of the grooves and the roughness of the face texture are preferably systematically varied through the set, as discussed in the parent '745 application.

Similarly, the hitting face (1016, 1116, 1216) is roughened by any means known in the art, such as spin milling or fly cutting to finish the surface. The surface roughness may be formed during manufacture of the face as a whole, such as by casting or forging with the texture, or the surface texture may be formed on the face after the face is formed, such as by milling, sandblasting, shot peening, or any other method known in the art. Typically, the roughness of a surface is measured as a Roughness Average (RA), the deviation expressed in microinches (μpin) measured normal to the center line, i.e., the location of the surface without any finishing texture. As discussed in the parent '745 application, the surface roughness can systematically increase through the set, with the smoothest surfaces in the long irons.

Other parameters may be varied systematically through the set, such as toe height, top angle, sole thickness, material alloy and/or hardness, insert type and hardness, face thickness and/or material, and coefficient of restitution. Also, the depth of the center of gravity may also be varied through the set, as the depth of the center of gravity affects flight performance as disclosed in U.S. Pat. No. 6,290,607, the disclosure of which is hereby incorporated by reference. Additionally, all of the equations discussed herein are examples and may have any variation desirable for performance continuum throughout the set. In other words, the particular equations developed herein may be altered or adjusted so that a design parameter progresses in alternate ways than those described herein by adjusting the relationship between for example, the offset and the loft angle. The design tolerances discussed herein are preferences and may be adjusted to account for inter alia different materials and aesthetics.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

We claim:

1. A set of iron-type golf clubs comprising:

at least one long iron comprising a first hitting face, a first rear face having a first channel formed therein, and a first insert sandwiched in the first channel, behind the first hitting face, having a first length $L_l$ and a first volume $V_l$ and a first mass $M_l$ ;

at least one mid iron comprising a second hitting face, a second rear face having a second channel formed therein, and a second insert disposed behind the second hitting face having a second length $L_2$ and second volume $V_2$ and a second mass $M_2$; and at least one short iron comprising a third hitting face, a third rear face having a third channel formed therein, and a third insert disposed behind the third hitting face having a third length $L_3$ and a third volume $V_3$ and a third mass $M_3$, wherein $L_1>L_2>L_3$and $V_1>V_2>V_3$and $M_1>M_2>M_3$and the sole width decreases between 0.725 inches and 0.635 inches in the set from the at least one long iron to the at least one short iron, and wherein each insert fills at least a majority of the respective channel to provide a consistent aesthetic and feel throughout the set.

2. The set of clubs according to claim 1, wherein the first rear face has a cavity back configuration.

3. The set of clubs of claim 1, wherein the long iron is an oversized club head.

4. The set of clubs of claim 1, wherein at least one club includes a vibration dampener embedded between the insert and the hitting face.

* * * * *